US010662626B2

(12) United States Patent
Lin

(10) Patent No.: US 10,662,626 B2
(45) Date of Patent: May 26, 2020

(54) FIXING DEVICE FOR A FAUCET MODULE

(71) Applicant: Ming-Shuan Lin, Taichung (TW)

(72) Inventor: Ming-Shuan Lin, Taichung (TW)

( * ) Notice: Subject to any disclaimer, the term of this patent is extended or adjusted under 35 U.S.C. 154(b) by 60 days.

(21) Appl. No.: 16/200,696

(22) Filed: Nov. 27, 2018

(65) Prior Publication Data

US 2020/0032496 A1 Jan. 30, 2020

(30) Foreign Application Priority Data

Jul. 26, 2018 (TW) ..... 107125900 A

(51) Int. Cl.
*E03C 1/04* (2006.01)

(52) U.S. Cl.
CPC ..... *E03C 1/0402* (2013.01); *E03C 1/0401* (2013.01); *Y10T 137/6014* (2015.04)

(58) Field of Classification Search
CPC ..... E03C 1/0402; E03C 1/0401
See application file for complete search history.

(56) References Cited

U.S. PATENT DOCUMENTS 5,778,546 A * 7/1998 Williamson ..... E04G 21/1833 33/1 H
2012/0234988 A1* 9/2012 Cheng ..... H01R 13/6395 248/73
2014/0263892 A1* 9/2014 Metcalfe ..... F16M 13/02 248/205.3
2015/0139752 A1* 5/2015 Torres ..... F16B 37/00 411/427

FOREIGN PATENT DOCUMENTS

TW M377503 U1 4/2010
WO WO-02068763 A1 * 9/2002 ..... E03C 1/0402

OTHER PUBLICATIONS

Search Report appended to an Office Action issued to Taiwanese counterpart application No. 107125900 by the TIPO dated Nov. 30, 2018, with an English translation thereof.

* cited by examiner

*Primary Examiner* — Eric Keasel
*Assistant Examiner* — Kevin R Barss
(74) *Attorney, Agent, or Firm* — Burris Law, PLLC

(57) ABSTRACT

A fixing device is adapted to be mounted on a plate that is formed with a mounting hole, and includes an upper fixing unit, a lower fixing unit, a string member and a first fastener. The upper fixing unit has two upper string through holes and a fastener through hole. The lower fixing unit has a first fastener engaging hole. The string member includes two penetration sections respectively extending through the upper string through holes and being connected to the lower fixing unit. When said string member is pulled, the first fastener engaging hole and the fastener through hole are aligned with each other. The first fastener extends through the fastener through hole to be engaged with the first fastener engaging hole.

10 Claims, 11 Drawing Sheets

FIXING DEVICE FOR A FAUCET MODULE

CROSS-REFERENCE TO RELATED APPLICATION

This application claims priority of Taiwanese Patent. Application No. 107125900, filed on. Jul. 26, 2018.

FIELD

The disclosure relates to a fixing device for a faucet module, more particularly to a fixing device having a string member.

BACKGROUND

Referring to FIGS. 1 and 2, Taiwanese Invention Patent No. I350354 discloses a conventional sensor faucet adapted for mounting to a panel 3 of a sink. The sensor faucet includes a fixing unit 1 and a valve unit 2 disposed on the fixing unit 1. The fixing unit 1 includes a fixing seat 101 disposed on a top surface of the panel 3, a lower plate 102 disposed on a bottom surface of the panel 3, a bolt member 103, a nut member 104 engaged with the bolt member 103, a positioning plate 105, and two screw members 106. The bolt member 103 extends through the positioning plate 105 and the lower plate 102, and is bolted to the fixing seat 101. The screw members 106 are screwed to the positioning plate 105 and abut against the lower plate 102. The lower plate 102 and the fixing seat 101 are respectively abutted against the bottom and top surfaces of the panel 3 by the screw members 106 and the bolt member 103.

However, it is difficult to align the fixing seat 101 and the lower plate 102 with the plate 3 in between. Moreover, the user needs to be under the panel 3 (and thus under the sink) in order to tighten the bolt member 103 and the screw members 106. Space is usually limited under the sink, making it inconvenient for the user to operate tools on the bolt member 103 and the screw members 106.

SUMMARY

Therefore, an object of the disclosure is to provide a fixing device for a faucet module that can alleviate at least one of the drawbacks of the prior art.

According to the disclosure, the fixing device is adapted to be mounted on a plate that is formed with a mounting hole, is adapted to be connected to a faucet module, and includes an upper fixing unit, a lower fixing unit, a string member and a first fastener.

The upper fixing unit is adapted to abut against a top surface of the plate, and has a pipe through hole that is adapted to be aligned to the mounting hole, two upper string through holes, and a fastener through hole.

The lower fixing unit is adapted to abut against a bottom surface of the plate and has a first fastener engaging hole.

The string member includes a connecting section that is disposed above the upper fixing unit, and two penetration sections that respectively extend from opposite ends of the connecting section. Each of the penetration sections is adapted to extend through the mounting hole, extends through a respective one of the upper string through holes, and connects to the lower fixing unit. When said string member is pulled, a distance between the upper fixing unit and the lower fixing unit is reduced, and the first fastener engaging hole and the fastener through hole are aligned with each other.

The first fastener is adapted to extend through the mounting hole and extends through the fastener through hole to be engaged with the first fastener engaging hole.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
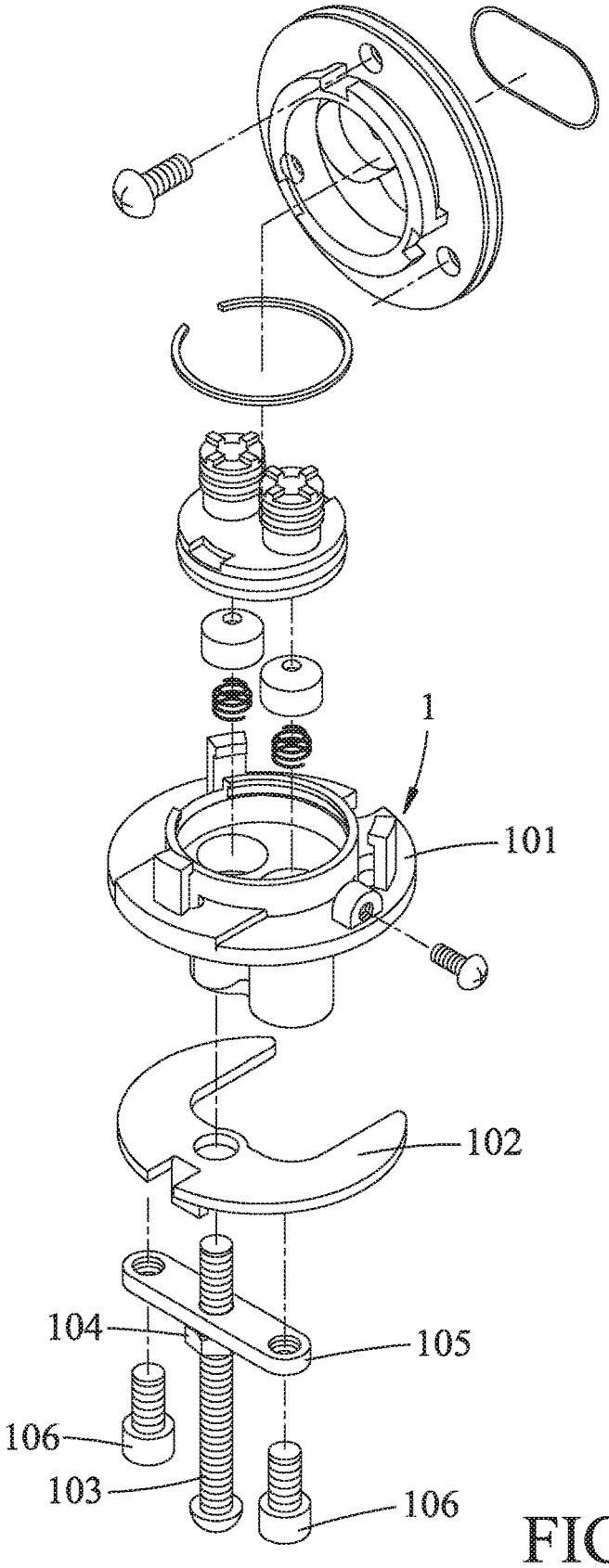
FIG.1 PRIOR ART
FIG. 1 is an exploded perspective view of conventional sensor faucet.
Figure 2:
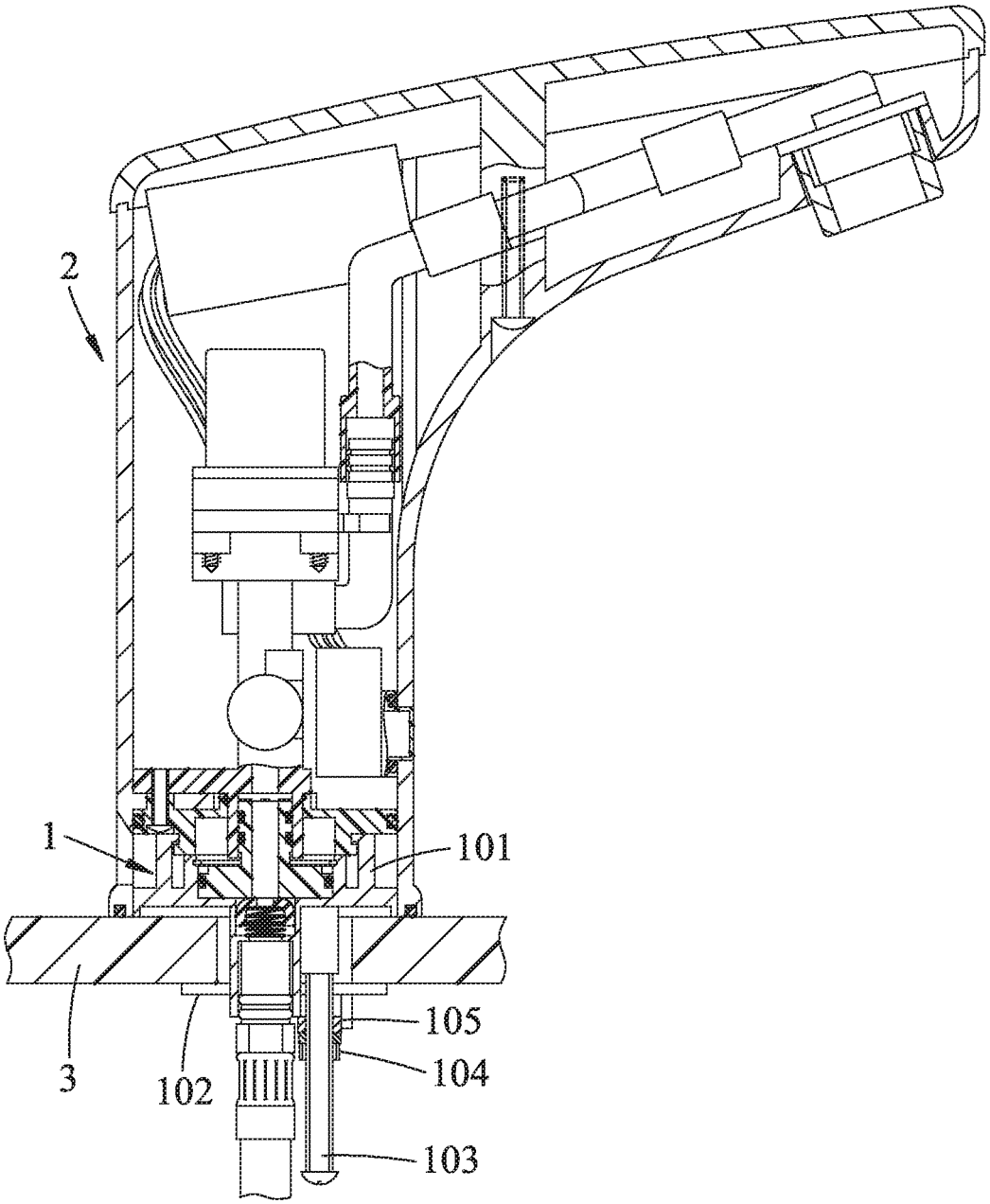
FIG.2 PRIOR ART
FIG. 2 is a sectional view of the conventional sensor faucet.
Figure 3:
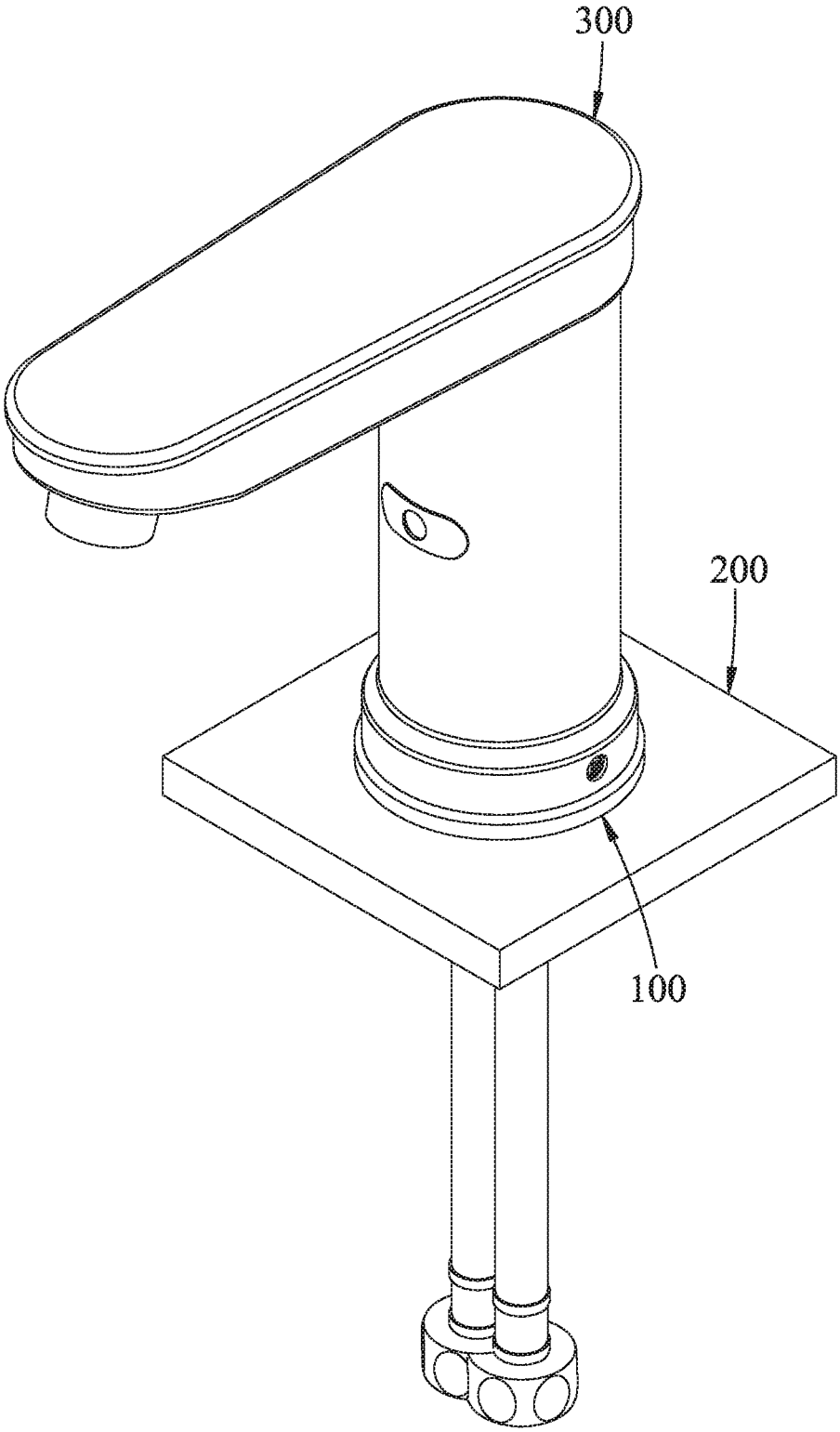
FIG. 3 is a perspective view of an embodiment of a fixing device according to the disclosure mounted on a plate and connected to a faucet module.
Figure 4:
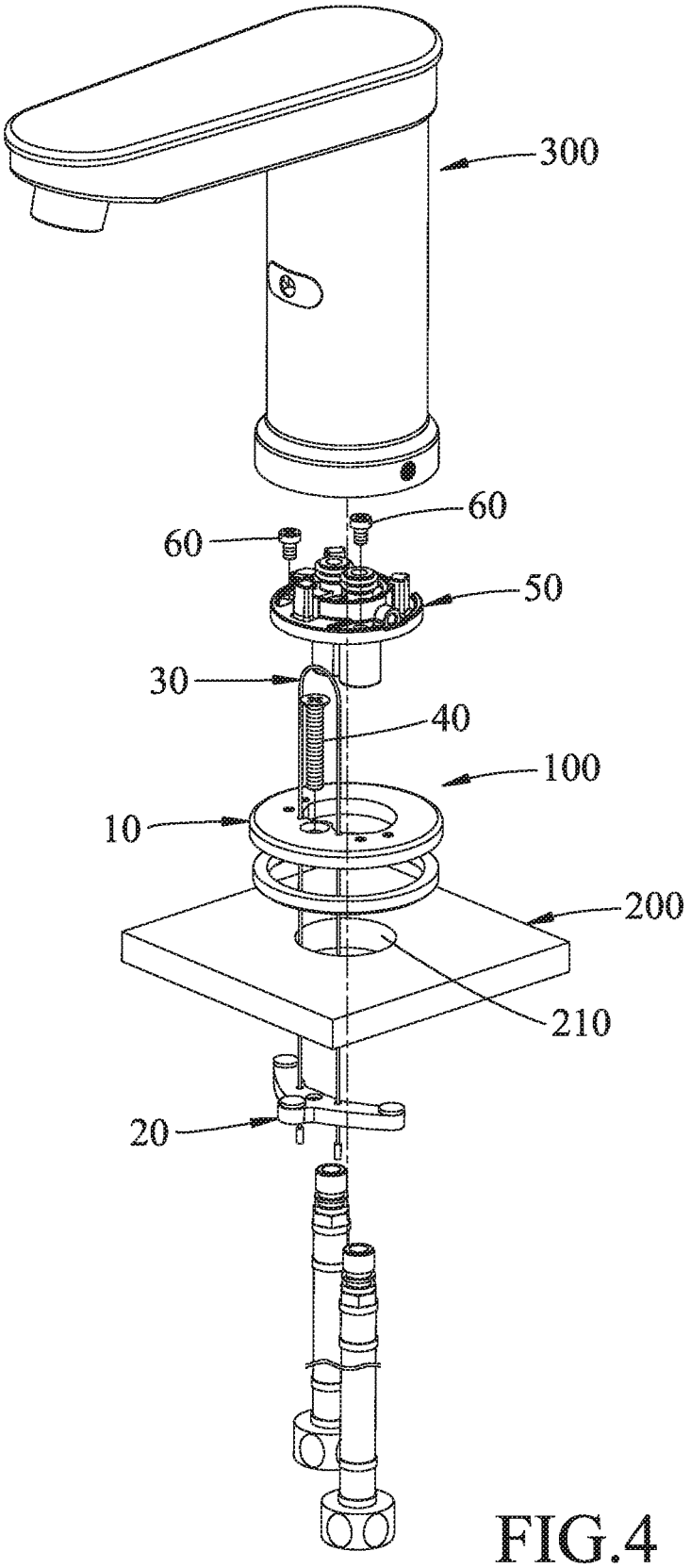
FIG. 4 is an exploded perspective view of the embodiment, the plate and the faucet module.

Referring to FIGS. 3 and 4, an embodiment of a fixing device 100 is adapted to be mounted on a plate 200 that is formed with a mounting hole 210, and adapted to be connected to a faucet module 300.

Figure 5:
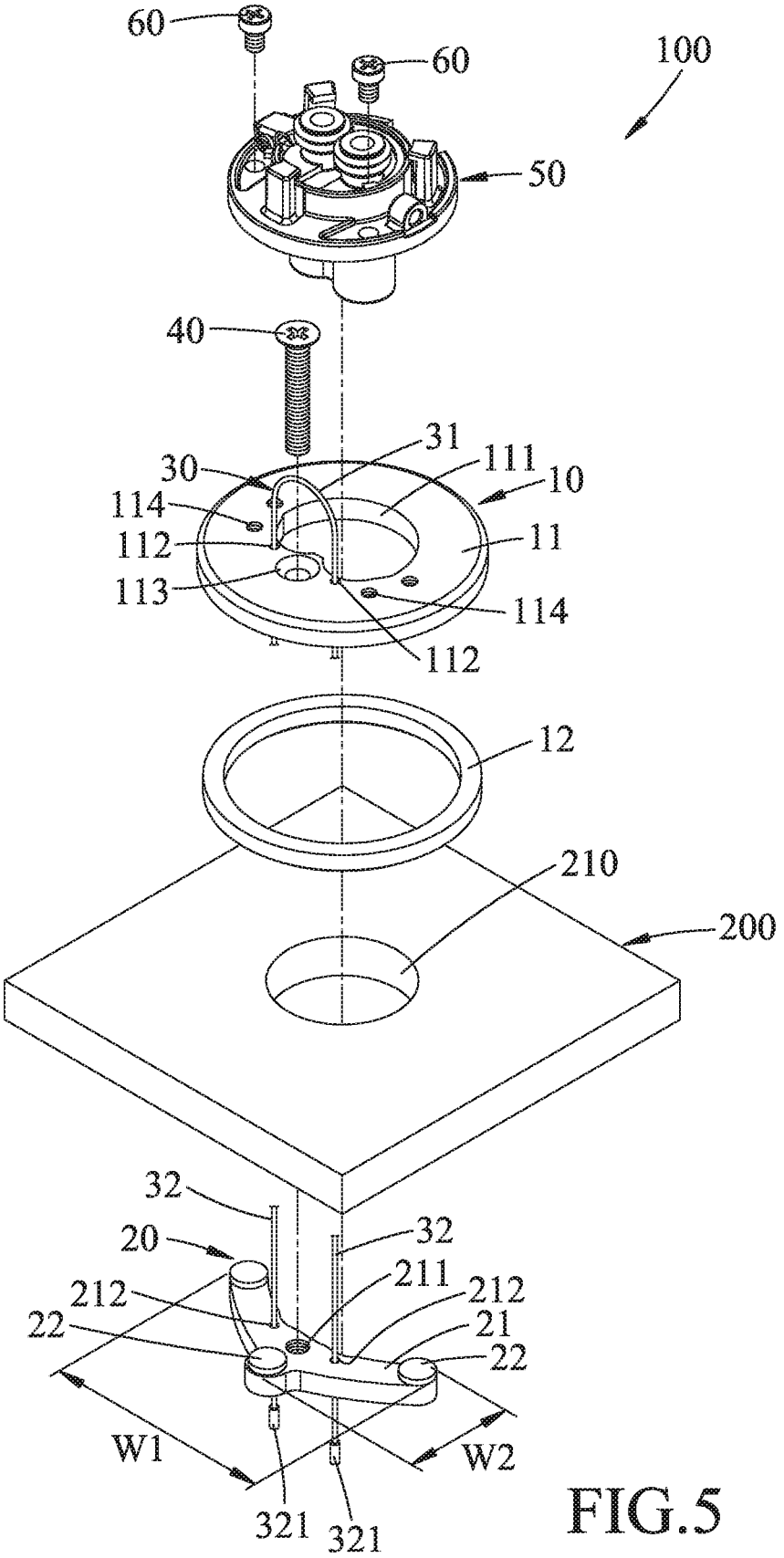
FIG. 5 is an exploded perspective view of the embodiment and the plate.

Referring to FIGS. 4 and 5, the fixing device 100 includes an upper fixing unit 10, a lower fixing unit. 20, string member 30, a first fastener 40, a faucet-connecting unit 50, and at least one second fastener 60.

Referring to FIGS. 4 to 7, the upper fixing unit 10 is adapted to abut against a top surface of the plate 200, and has an upper seat 11 and a slip ring 12. The upper seat 11 has a pipe through hole 111 that is adapted to be aligned to the mounting hole 210, two upper string through holes 112, a fastener through hole 113, at least one second fastener engaging hole 114, and a bottom surface formed with an annular groove 115. The slip ring 12 is disposed within the annular groove 115 and is adapted to frictionally abut against the top surface of the plate 200.

In this embodiment, the upper string through holes 112 are disposed substantially symmetrically with respect to the fastener through hole 113 and at two sides of the fastener through hole 113. In this embodiment, the fixing unit 100 includes two of the second fasteners 60, and the upper seat 11 has two of the second fastener engaging holes 114.

The lower fixing unit 20 is adapted to abut against a bottom surface of the plate 200 and includes a lower seat 21 and at least one slip-resistant block 22. The slip-resistant block 22 is adapted to frictionally abut against the bottom surface of the plate 200. In this embodiment, the lower fixing unit 20 includes three of the slip-resistant blocks 22.

The lower seat 21 has a first fastener engaging hole 211 and two lower string through holes 212.

In this embodiment, the lower string through holes 212 are disposed substantially symmetrically with respect to the first fastener engaging hole 211 and at two sides of the first fastener engaging hole 211. In this embodiment, the lower fixing unit 20 has a first width (W1) that is larger than a diameter of the mounting hole 210 of the plate 200 and a second width (W2) that is smaller than the diameter of the mounting hole 210 of the plate 200 so as to allow the lower fixing unit 20 to pass through the mounting hole 210 during assembly.

Figure 7:
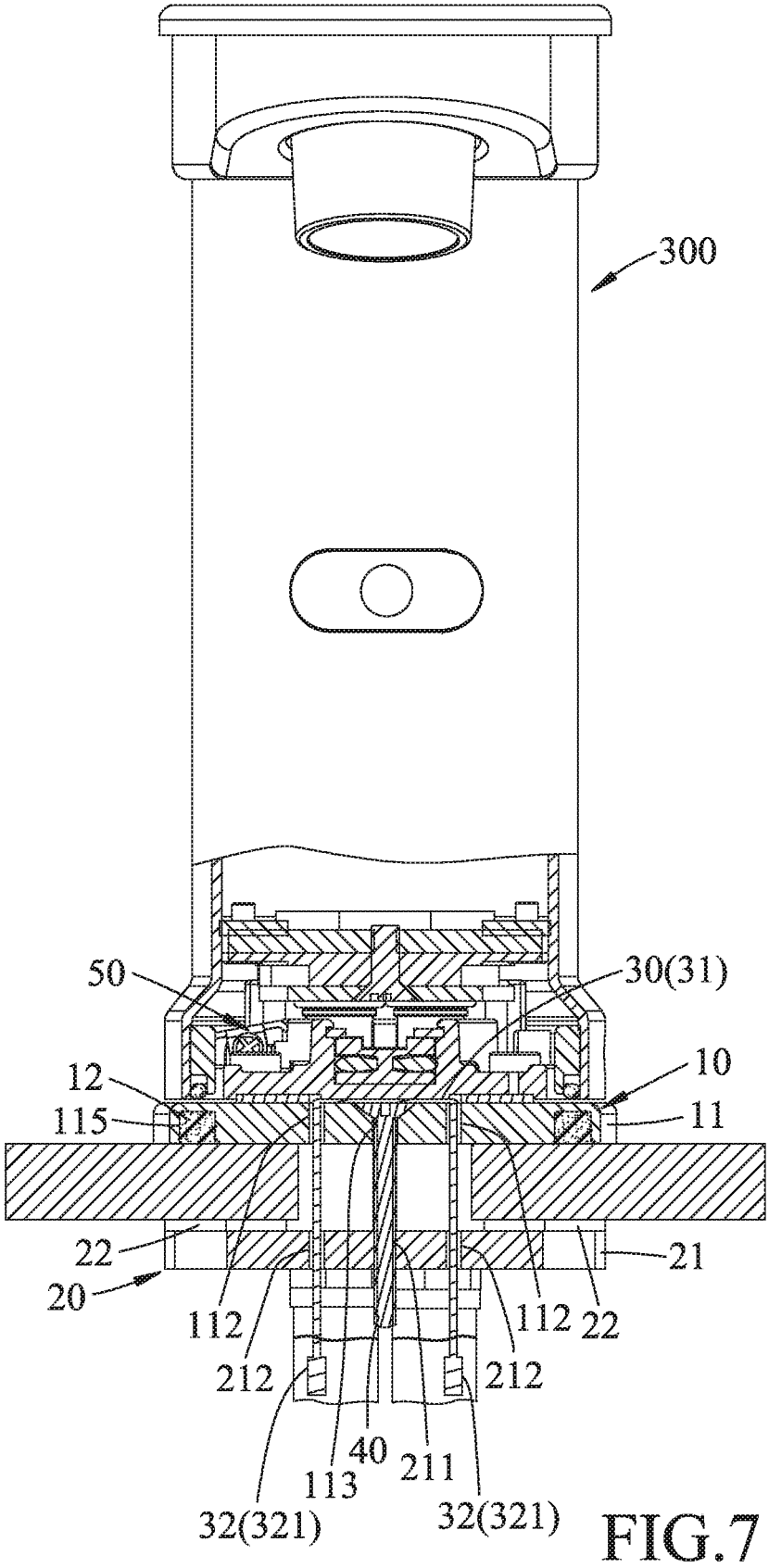
FIG. 7 is a partially sectional view taken across line VII-VII in FIG. 6.

Referring to FIGS. 4, 5, and 7, the string member 30 includes a connecting section 31 that is disposed above the upper fixing unit 10, and two penetration sections 32 that respectively extend from opposite ends of the connecting section 31. The penetration sections 32 are adapted to extend through the mounting hole 210. Each of the penetration sections 32 extends through a respective one of the upper string through holes 112 and is connected to the lower fixing unit 20. In this embodiment, each of the penetration sections 32 extends through the respective one of the upper string through holes 112 and the respective one of the lower string through holes 212, and has a block portion 321 that is disposed under the lower fixing unit 20 and that has a diameter larger than that of a respective one of the lower string through holes 212. Thus, the block portions 321 can prevent the penetration sections 32 from being disconnected from the lower seat 21. The block portion 321 of each of the penetration sections 32 may be a clip or a knot located at an end of the penetration section 32.

When the string member 30 is pulled, a distance between the upper fixing unit 10 and the lower fixing unit 20 is reduced, and the first fastener engaging hole 211 and the fastener through hole 113 are aligned with each other.

The first fastener 40 is adapted to extend through the mounting hole 210 and extends through the fastener through hole 113 to be engaged with the first fastener engaging hole 211. In this embodiment, the first fastener 40 is a screw and the first fastener engaging hole 211 is a threaded hole. In certain embodiments, the first fastener 40 is a screw, and the first fastener engaging hole 211 and the fastener through hole 113 are threaded holes.

Figure 8:
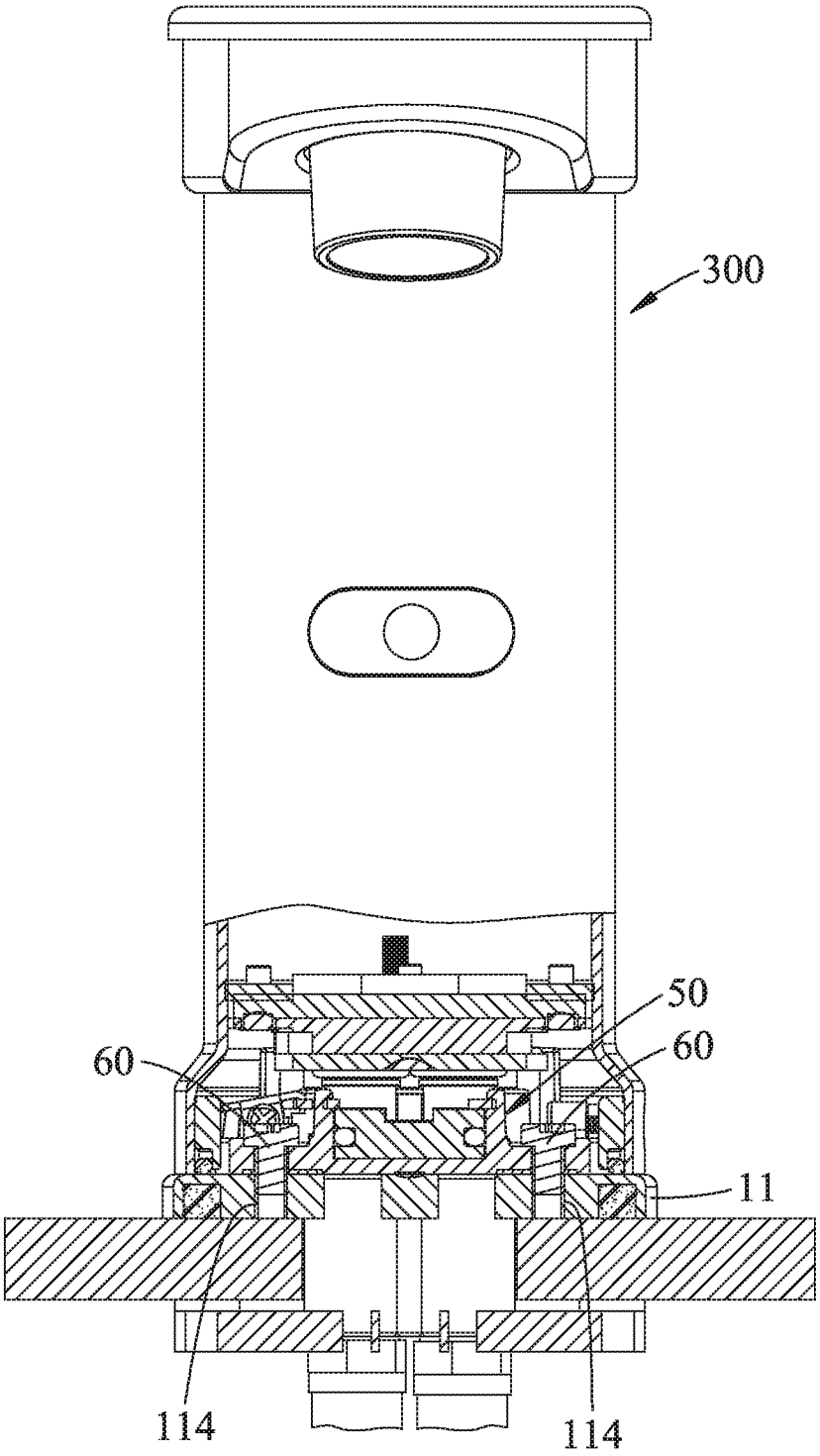
FIG. 8 is a view similar to FIG. 7, illustrating a faucet-connecting unit of the embodiment mounted to an upper seat of the embodiment.

Referring to FIGS. 4, 5, and 8, the faucet-connecting unit 50 is mounted to the upper seat 11 by the second fasteners 60. To be specific, the second fasteners 60 extend through the faucet-connecting unit 50 to be respectively engaged with the second fastener engaging holes 114 so that the faucet-connecting unit 50 is mounted and secured to the upper seat 11. The faucet-connecting unit 50 is adapted to be connected with the faucet module 300, and so the faucet module 300 is connected to the upper seat 11 through the faucet-connecting unit 50 and second fasteners 60. In this embodiment, the faucet module 300 is removably connected to the faucet-connection unit 50, and the second fasteners 60 and the second fastener engaging holes 114 are respectively screws and threaded holes.

Figure 6:
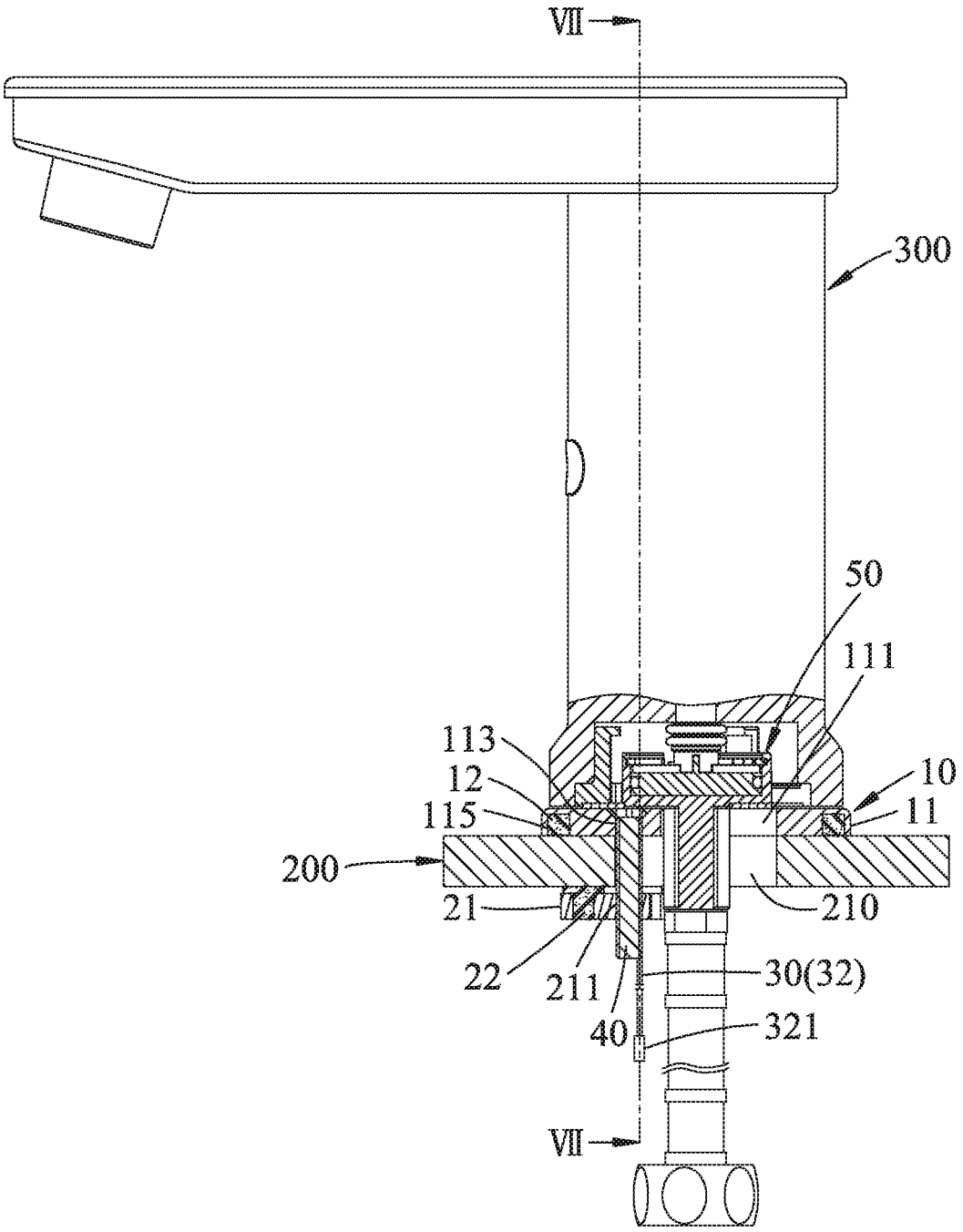
FIG. 6 is a partially sectional view of the embodiment and the plate.
Figure 9:
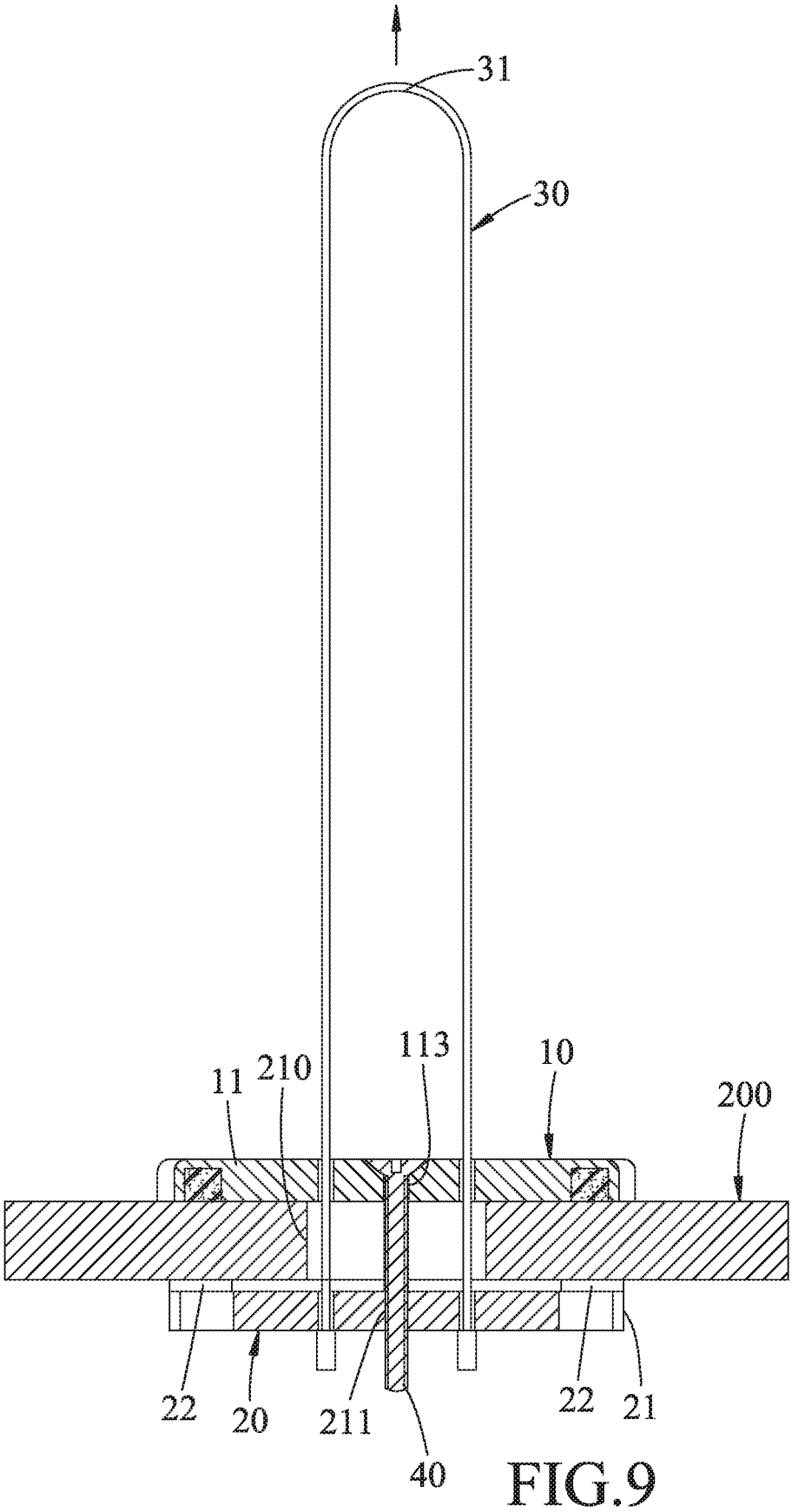
FIG. 9 is a partly sectional view, illustrating a string member of the embodiment that is pulled to reduce a distance between upper and lower fixing units of the embodiment.

When a user wishes to install the fixing device 100 onto the plate 200, as shown in FIG. 4, the user may pass the lower fixing unit 20 through the mounting hole 210 of the plate 200, so that the lower fixing unit 20 is disposed under the plate 200. Then, as shown in FIG. 9, the user may use one hand to abut the upper fixing unit 10 against the top surface of the plate 200 and simultaneously use the other hand to hold the connecting section 31 of the string member 30, pulling the string member 30 along with the lower fixing unit 20 up, until the slip-resistant blocks 22 abut against the bottom surface of the plate 200. In this process, the distance between the lower and the upper fixing units 20, 10 is minimized using the string member 30. Further, the string member 30 guides the first fastener engaging hole 211 of the lower seat 21 to align with the fastener through hole 113 of the upper seat 11. Next, further shown FIG. 9, the user may insert the first fastener 40 through the fastener through hole 113 of the upper seat 11 and the mounting hole 210 of the plate 200 to engage the first fastener 40 with the first fastener engaging hole 211 of the lower seat 21, fixing the upper fixing unit 10 and the lower fixing unit 20 to the plate 200. Next, as shown in FIG. 7, the user may move the string member 30 downwards until the connecting section 31 is proximal to a top surface of the upper seat 11. Next, as shown in FIG. 8, the user may insert the second fasteners 60 through the faucet-connecting unit 50 to engage the second fasteners 60 with the second fastener engaging holes 114 of she upper seat 11, so as to fix the faucet-connecting unit 50 to the upper seat 11. Finally, as shown in FIGS. 6 and 7, the user may connect the faucet module 300 to the faucet-connecting unit 50, finishing the assembly.

As can be seen from the above description, the fixing device of the disclosure provides the following benefits:

1. With the string member 30, the first fastener engaging hole 211 of the lower fixing unit 20 and the fastener through hole 113 of the upper fixing unit 10 could align with each other upon assembly, so that the fastener 40 may be easily inserted into the fastener through hole 113 of the upper seat 11 and the mounting hole 210 of the plate 200 to engage with the first fastener engaging hale 211 of the lower seat 21, thereby securing the upper and lower fixing units 10, 20 onto the plate 200.

2. With the connecting section of the string member 30 disposed above the upper fixing unit 10, pulling of the string member 30 is easily operated.

3. With the slip ring 12 of the upper fixing unit 10 and the slip-resistant block 22 of the lower fixing unit 20 abutted respectively against the top and bottom surfaces of the plate 200, the upper and lower fixing units 10, 20 may not slide relative to the plate 200.

Figure 10:
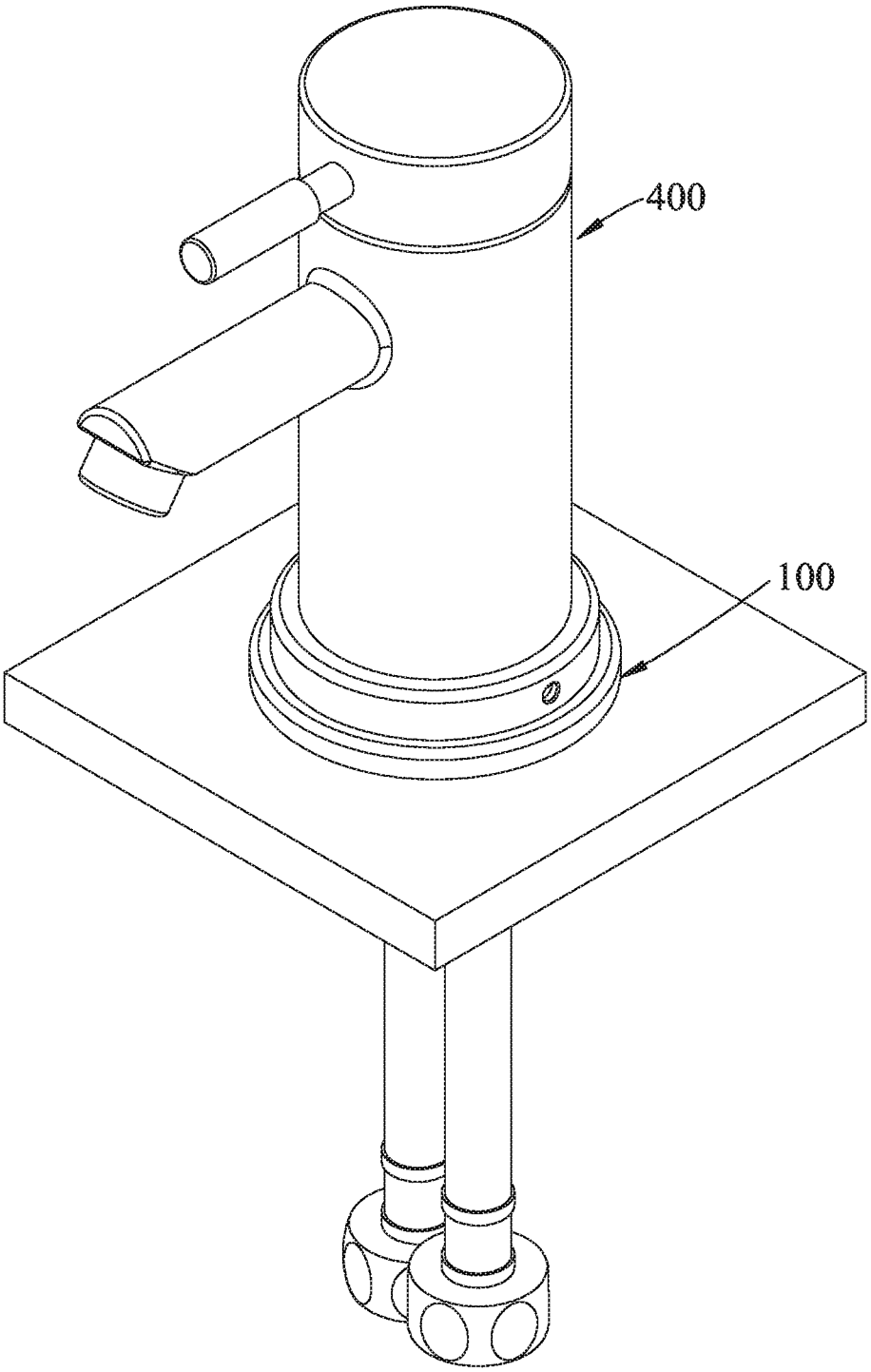
FIG. 10 is a view similar to FIG. 3, illustrating the embodiment of the fixing device according to the disclosure connected to another faucet module.
Figure 11:
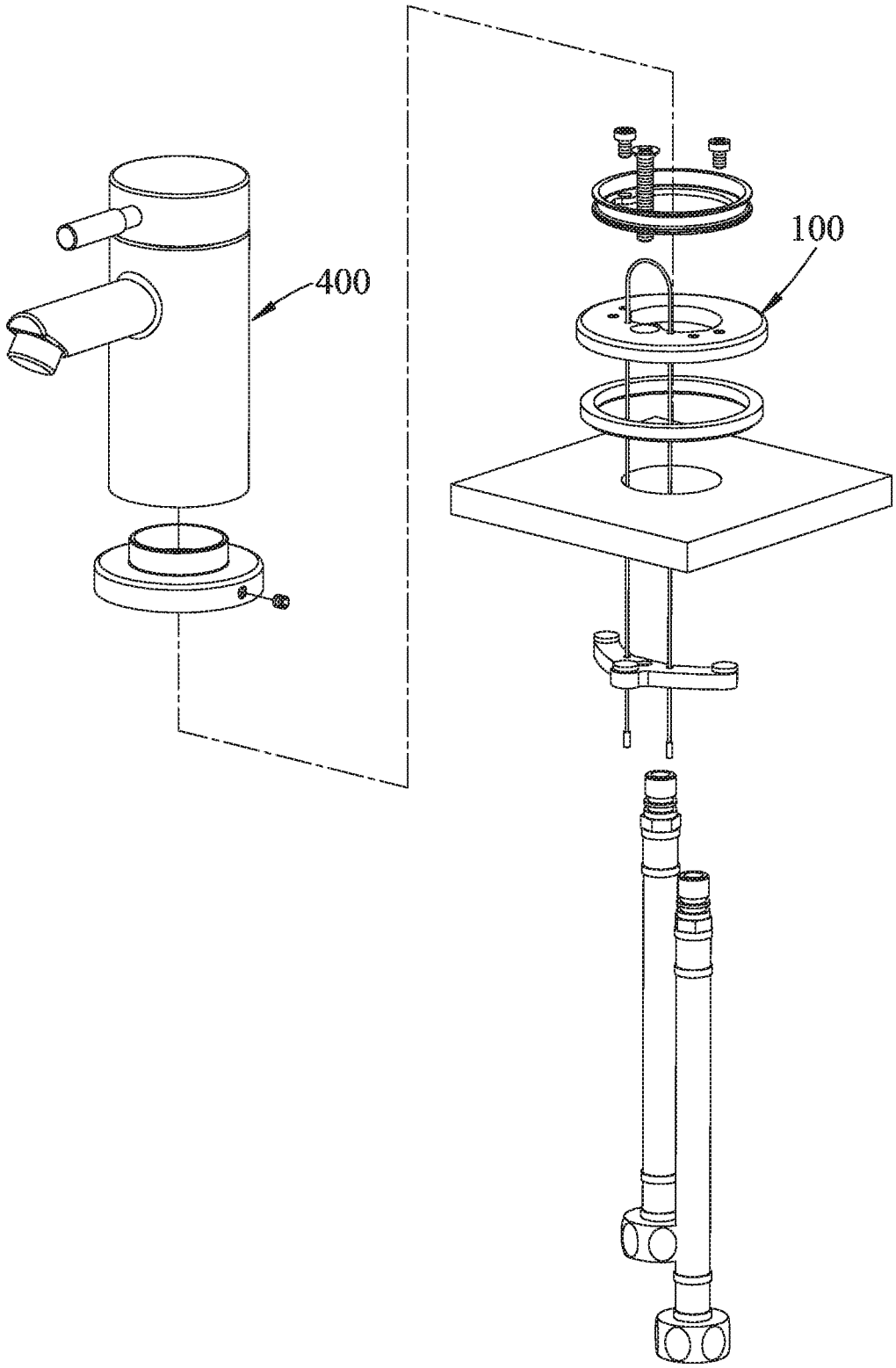
FIG. 11 is an exploded perspective view of FIG. 10.

Referring to FIGS. 10 and 11, it should be noted that the fixing device 100 can be also be connected to a faucet module 400 with a different structure. In such cases, the structure of the faucet-connecting unit 50 may vary to suit the faucet module 400.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and sa forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A fixing device adapted to be mounted on a plate that is formed with a mounting hole, and adapted to be connected to a faucet module, said fixing device comprising:

an upper fixing unit that is adapted to abut against a top surface of the plate, and that has a pipe through hole that is adapted to be aligned to the mounting hole, two upper string through holes, and a fastener through hole;

a lower fixing unit that is adapted to abut against a bottom surface of the plate and that has a first fastener engaging hole;

a string member that includes a connecting section that is disposed above said upper fixing unit, and two penetration sections that respectively extend from opposite ends of said connecting section, each of said penetration sections being adapted to extend through the mounting hole, extending through a respective one of said upper string through holes, and being connected to said lower fixing unit, wherein, when said string member is pulled, a distance between said upper fixing unit and said lower fixing unit reduced, and said first fastener engaging hole and said fastener through hole are aligned with each other; and a first fastener that is adapted to extend through the mounting hole and that extends through said fastener through hole to be engaged with said first fastener engaging hole.

2. The fixing device as claimed in claim 1, wherein said lower fixing unit further has two lower string through holes through which said penetration sections extend respectively, each of said penetration sections having a block portion that is disposed under said lower fixing unit and that has a diameter larger than that of a respective one of said lower string through holes.

3. The fixing device as claimed in claim 2, wherein said lower fixing unit includes a lower seat having said first fastener engaging hole and said lower string through holes, and at least one slip-resistant block that is adapted to frictionally abut against the bottom surface of the horizontal plate.

4. The fixing device as claimed in claim 3, wherein said lower string through holes of said lower fixing unit are disposed substantially symmetrically with respect to said first fastener engaging hole.

5. The fixing device as claimed in claim 1, wherein said upper fixing unit further has:

an upper seat having said pipe through hole, said upper string through holes, said fastener through hole, and a bottom surface formed with an annular groove, and a slip ring that is disposed within said annular groove and that is adapted to frictionally abut against the top surface of the plate.

6. The fixing device as claimed in claim 5, wherein said upper string through holes of said upper fixing unit are disposed substantially symmetrically with respect to said fastener through hole.

7. The fixing device as claimed in claim 5, wherein:

said upper seat of said upper fixing unit further has at least one second fastener engaging hole; and the fixing device further comprises a faucet-connecting unit that is adapted to be connected with the faucet module and that is mounted to said upper seat of said upper fixing unit, and at least one second fastener that extends through said faucet-connecting unit to be respectively engaged with said at least one second fastener engaging hole.

8. The fixing device as claimed in claim 7, wherein said at least one second fastener is a screw and said at least one second fastener engaging hole is a threaded hole.

9. The fixing device as claimed in claim 1, wherein said lower fixing unit has a first width that is larger than a diameter of the mounting hole of the horizontal plate and a second width that is smaller than the diameter of the mounting hole of the horizontal plate so as to allow said lower fixing unit to pass through the mounting hole during assembly.

10. The fixing device as claimed in claim 1, wherein said first fastener is a screw, and said first fastener engaging hole of said lower fixing unit is a threaded hole.

* * * * *